US008417137B2

(12) United States Patent
Naitoh et al.

(10) Patent No.: US 8,417,137 B2
(45) Date of Patent: Apr. 9, 2013

(54) FIXING DEVICE AND IMAGE FORMING APPARATUS EMPLOYING THE FIXING DEVICE

(75) Inventors: Yutaka Naitoh, Itami (JP); Toshio Ogiso, Toyonaka (JP); Tamotsu Ikeda, Takatsuki (JP)

(73) Assignee: Ricoh Company Limited, Tokyo (JP)

( * ) Notice: Subject to any disclaimer, the term of this patent is extended or adjusted under 35 U.S.C. 154(b) by 628 days.

(21) Appl. No.: 12/461,314

(22) Filed: Aug. 7, 2009

(65) Prior Publication Data

US 2010/0034548 A1 Feb. 11, 2010

(30) Foreign Application Priority Data

Aug. 8, 2008 (JP) ..... 2008-205737
Mar. 31, 2009 (JP) ..... 2009-085467

(51) Int. Cl.
*G03G 15/20* (2006.01)

(52) U.S. Cl.
USPC ..... 399/69; 399/33; 399/328; 399/337; 219/216

(58) Field of Classification Search ..... 399/33, 399/67–70, 122.32, 322, 335–339; 219/216, 219/619
See application file for complete search history.

(56) References Cited

U.S. PATENT DOCUMENTS

| | | | | |
|---|---|---|---|---|
| 6,336,010 | B1 * | 1/2002 | Kuwabara | 399/68 |
| 2007/0059013 | A1 * | 3/2007 | Mori et al. | 399/69 |
| 2008/0013993 | A1 | 1/2008 | Obata et al. | |
| 2008/0056783 | A1 | 3/2008 | Yamamoto et al. | |
| 2008/0069611 | A1 | 3/2008 | Obata et al. | |
| 2008/0193162 | A1 | 8/2008 | Yamazoe et al. | |
| 2009/0022531 | A1 | 1/2009 | Kubota et al. | |
| 2009/0060572 | A1 | 3/2009 | Naitoh et al. | |
| 2009/0074440 | A1 | 3/2009 | Nanno et al. | |
| 2009/0110418 | A1 | 4/2009 | Ogiso et al. | |
| 2009/0110449 | A1 | 4/2009 | Saito et al. | |
| 2009/0129836 | A1 | 5/2009 | Sakaya et al. | |
| 2009/0162101 | A1 | 6/2009 | Yoshida et al. | |
| 2009/0162772 | A1 | 6/2009 | Fuwa et al. | |

FOREIGN PATENT DOCUMENTS

| | | |
|---|---|---|
| JP | 57-078070 | 5/1982 |
| JP | 1-40352 | 8/1983 |
| JP | 61-31463 | 7/1986 |

OTHER PUBLICATIONS

Abstract of 59-072464, Apr. 24, 1984, submitted for 61-31463.
Abstract of 58-052667, Mar. 28, 1983 submitted for 1-40352.

* cited by examiner

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A fixing device includes a rotary fixing member, a counter member to contact the rotary fixing member, a first heater to heat the rotary fixing member, a driving unit to rotate the rotary fixing member, a temperature detector to detect a temperature of the rotary fixing member, and a contact-and-separation unit to switch between contact and separation states of the rotary fixing member relative to the counter member. In a temperature-raising operation, the driving unit causes the rotary fixing member to rotate when the temperature detector detects that the temperature of the rotary fixing member has reached a first setting temperature. The contact-and-separation unit causes the rotary fixing member in rotation and the counter member to contact each other when the temperature detector detects that the temperature of the rotary fixing member has reached a second setting temperature that is higher than the first setting temperature.

16 Claims, 5 Drawing Sheets

FIXING DEVICE AND IMAGE FORMING APPARATUS EMPLOYING THE FIXING DEVICE

CROSS-REFERENCE TO RELATED APPLICATIONS

The present patent application claims priority pursuant to 35 U.S.C. §119 from Japanese Patent Application Nos. 2008-205737, filed on Aug. 8, 2008, and 2009-085467, filed on Mar. 31, 2009 in the Japan Patent Office, each of which is hereby incorporated-herein by reference in its entirety.

BACKGROUND OF THE INVENTION

1. Field of the Invention

Illustrative embodiments of the present invention relate to a fixing device and an image forming apparatus, such as a copier and a laser printer, employing the fixing device.

2. Description of the Background

An image forming apparatus is used as a printer, a facsimile machine, a copier, a plotter, or a multi-functional peripheral having several of the foregoing capabilities. One conventional image forming apparatus performs image formation by an electrographic method. Such an electrophotographic image forming apparatus includes a fixing device that fixes a toner image on a recording medium, such as a paper sheet, by heating and pressing the toner image onto the sheet.

As illustrated in FIG. 1, for example, one conventional fixing device includes a fixing roller 100 serving as a rotary fixing member including a heater 300 and a pressure roller 200 serving as a rotary pressure member contacting the fixing roller 100 with pressure. When a recording medium P passes between the fixing roller 100 and the pressure roller 200 at a contact portion thereof, the recording medium P is heated and pressed so that an unfixed toner image T is fixed on the recording medium P.

After the heater 300 is turned on, the fixing device performs a warm-up operation to raise the temperature of the fixing roller 100 to a fixing target temperature at which the unfixed toner image T can be fixed on the recording medium P. When the heater 300 is turned on in the warm-up operation with the fixing roller 100 and the pressure roller 200 stopped, the temperature of the fixing roller 100 rises across the entire surface of the fixing roller but the temperature of the pressure roller 200 rises only in an area surrounding that portion of the pressure roller 200 contacting the fixing roller 100. In such a case, even if the fixing roller 100 rises to the target temperature, when the fixing roller 100 and the pressure roller 200 are rotated for fixing operation, the heat of the fixing roller 100 is absorbed by the unevenly heated pressure roller 200, causing fixing failure.

By contrast, when heating is performed while rotating the fixing roller 100 and the pressure roller 200, the temperature of both the fixing roller 100 and the pressure roller 200 as a whole rises, preventing such fixing failure. However, in the warm-up operation, heat is radiated from the pressure roller 200, thus lengthening warm-up time.

In such a situation, certain approaches have been proposed to shorten the warm-up time.

For example, one conventional fixing device stops rotating a fixing roller from the turning-on of a heater until the temperature of the fixing roller rises to a first setting temperature, and starts rotating the fixing roller when the temperature of the fixing roller has reached the first setting temperature. Such a configuration may prevent heat radiation from a heating roller, enhancing the speed of temperature rise.

Another conventional fixing device stops rotating a fixing roller from the turning-on of a heater until the temperature of the fixing roller rises to a fixing target temperature. Such a configuration may prevent heat radiation until the temperature of the fixing roller rises to the target temperature, thus enhancing the speed of temperature rise. After the temperature of the fixing roller has reached the target temperature, the rotation of the fixing roller is started to raise the temperature of a pressure roller.

As described above, in the above-mentioned conventional fixing devices, by stopping rotation of the fixing roller and the pressure roller in the warm-up operation, warm-up time is shortened. However, in such cases, since the fixing roller and the pressure roller contact each other, the heat of the heater is conducted to the pressure roller via the fixing roller and is radiated from the pressure roller. Such heat radiation from the pressure roller lengthens warm-up time.

SUMMARY OF THE INVENTION

The present disclosure provides a fixing device capable of effectively raising the temperature of a rotary fixing member and an image forming apparatus employing the fixing device.

In one illustrative embodiment, a fixing device includes a rotary fixing member, a counter member to contact the rotary fixing member at a contact portion through which a recording medium is passed to fix an image thereon, a first heater to heat the rotary fixing member, a driving unit to rotate the rotary fixing member, a temperature detector to detect a temperature of the rotary fixing member, and a contact-and-separation unit to switch between contact and separation states of the rotary fixing member relative to the counter member. In a temperature-raising operation of raising the temperature of the rotary fixing member to a temperature at which the image is fixed on the recording medium, the driving unit causes the rotary fixing member to rotate when the temperature detector detects that the temperature of the rotary fixing member has reached a first setting temperature. The contact-and-separation unit causes the rotary fixing member in rotation and the counter member to contact each other when the temperature detector detects that the temperature of the rotary fixing member has reached a second setting temperature that is higher than the first setting temperature.

In another illustrative embodiment, an image forming apparatus includes a fixing device. The fixing device includes a rotary fixing member, a counter member to contact the rotary fixing member at a contact portion through which a recording medium is passed to fix an image thereon, a first heater to heat the rotary fixing member, a driving unit to rotate the rotary fixing member, a temperature detector to detect a temperature of the rotary fixing member, and a contact-and-separation unit to switch between contact and separation states of the rotary fixing member relative to the counter member. In a temperature-raising operation of raising the temperature of the rotary fixing member to a temperature at which the image is fixed on the recording medium, the driving unit causes the rotary fixing member to rotate when the temperature detector detects that the temperature of the rotary fixing member has reached a first setting temperature. The contact-and-separation unit causes the rotary fixing member in rotation and the counter member to contact each other when the temperature detector detects that the temperature of the rotary fixing member has reached a second setting temperature that is higher than the first setting temperature.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
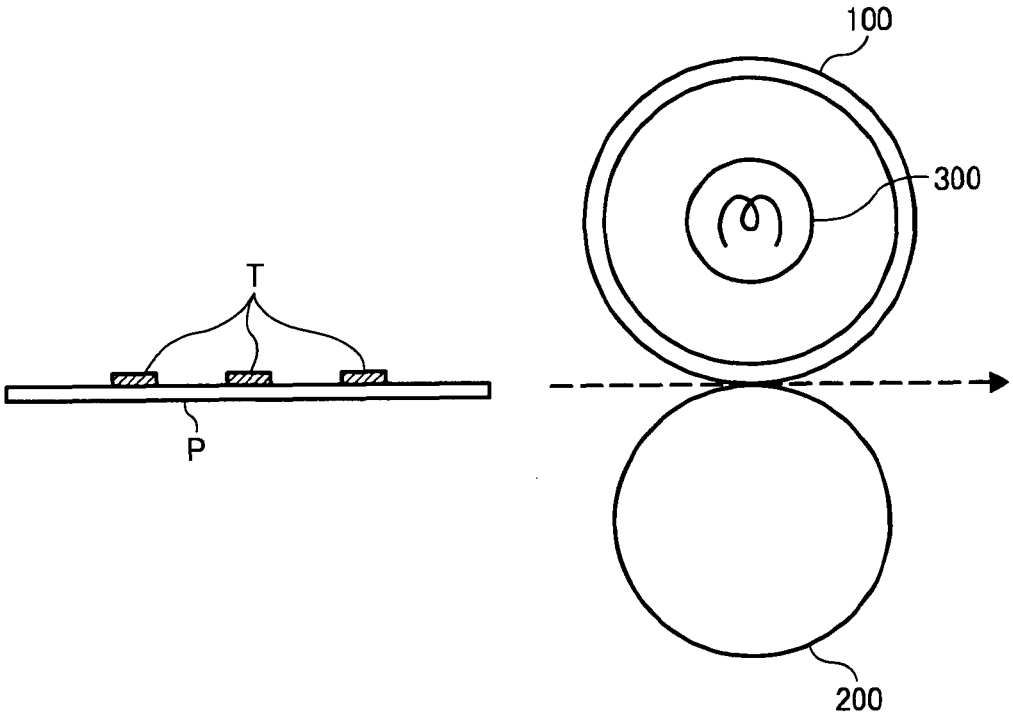
FIG. 1 is a schematic view illustrating a configuration of a conventional fixing device.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present invention are described with reference to attached drawings.

Figure 2:
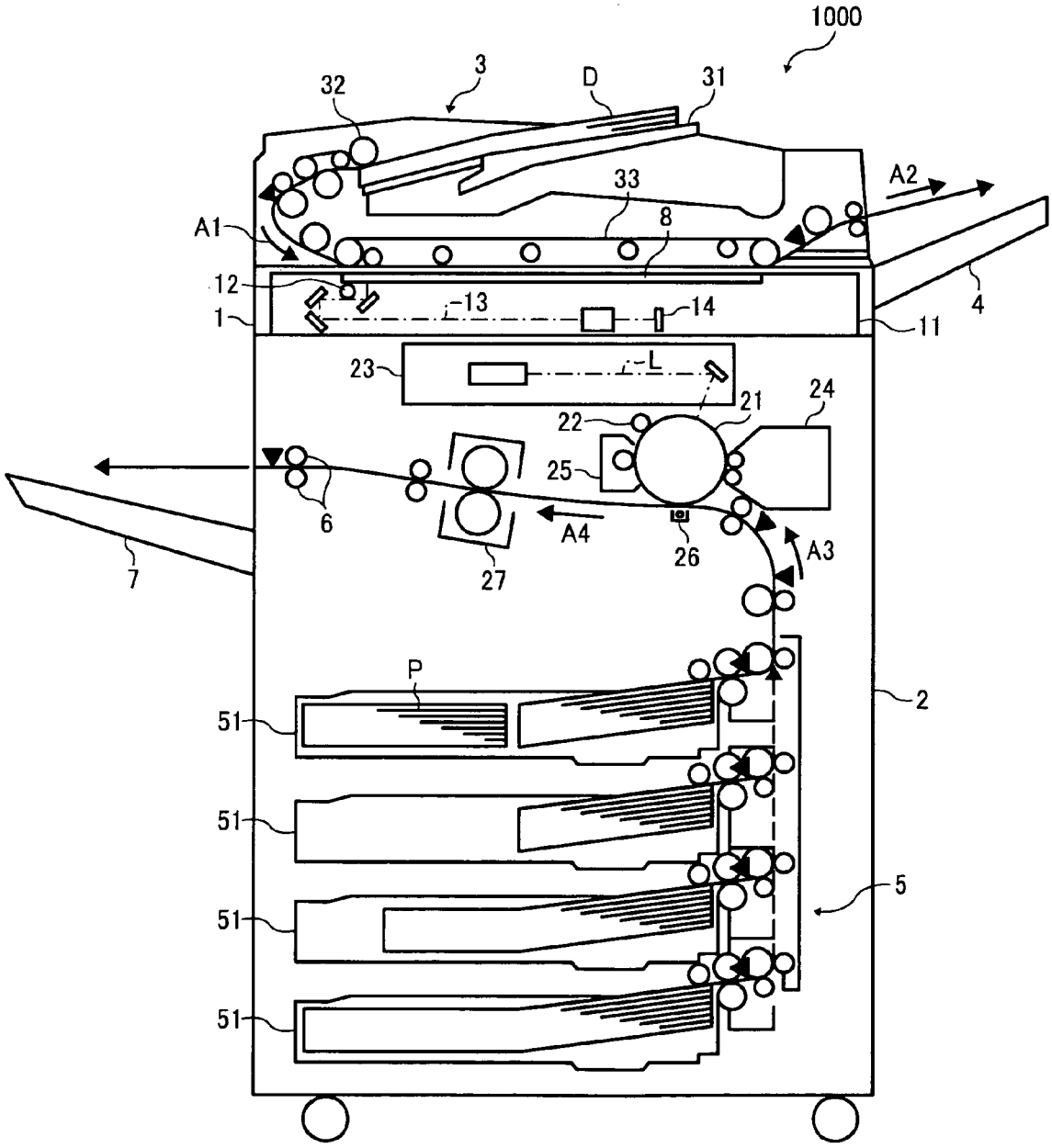
FIG. 2 is a schematic view illustrating a configuration of an image forming apparatus according to an illustrative embodiment of the present disclosure.

FIG. 2 is a schematic view illustrating a configuration of an electrophotographic image forming apparatus 1000 according to an illustrative embodiment of the present disclosure. In FIG. 2, the image forming apparatus 1000 includes a document reading unit 1 that reads an original document, an image forming section 2 that forms an image, a document feeder 3 that feeds an original document, a document output tray 4 that stacks the original document output from the document feeder 3, a sheet feed unit 5 that feeds a recording sheet serving as a recording medium, a pair of output rollers 6 that outputs a recording sheet to, the outside of the image forming apparatus 1000, and a sheet output tray 7 to receive the recording sheet. On the document reading unit 1 is fixed a contact glass 8.

The document reading unit 1 includes a reading device 11 disposed between the image forming section 2 and the contact glass 8. The reading device 11 includes, for example, a light source 12 that illuminates an original document on the contact glass 8, an optical system 13 that focuses a document image, and a photoelectric conversion device 14, such as a CCD (charge-coupled device), to form the focused image.

The image forming section 2 includes a photoconductor 21 serving as an image carrier, a charging device 22 that charges the surface of the photoconductor 21, an optical writing unit 23 that emits a laser beam L onto the surface of the photoconductor 21, a developing device 24 that supplies toner to the surface of the photoconductor 21, a cleaning device 25 that cleans the surface of the photoconductor 21, a transfer device 26 that transfers a toner image, which has been formed on the photoconductor 21, onto a recording sheet, and a fixing device 27 that fixes the transferred toner image on the recording sheet.

The document feeder 3 includes a document table 31 on which a document D is placed, a pick-up roller 32 that feeds the document D from the document table 31, and a document conveyance belt 33 that conveys the document D to the contact glass 8. In the sheet feed section 5 is provided a plurality of sheet feed cassettes 51 that accommodates recording sheets P.

Below, basic operation of the image forming apparatus 1000 is described with reference to FIG. 2.

A document D is placed on the document table 31. When a start button of an operation panel is pressed, the pick-up roller 32 is rotated to feed the document D in a direction indicated by an arrow A1. The document D is conveyed to the contact glass 8 by the rotation of the document conveyance belt 33. The reading device 11 reads an image of the document D on the contact glass 8. After the image reading, the document D is conveyed in a direction indicated by an arrow A2 by the document conveyance belt 33 and output to the document output tray 4.

In the image forming section 2, when the photoconductor 21 is rotated in a clockwise direction in FIG. 2, the charging device 22 uniformly charges the surface of the photoconductor 21 with a high potential. Based on image information read by the reading device 11, the optical writing unit 23 emits a laser beam L onto the surface of the photoconductor 21. As a result, the electric potential of a portion of the photoconductor 21 illuminated with the laser beam L falls so that an electrostatic latent image is formed on the photoconductor 21. The developing device 24,supplies electrostatically-charged toner to the electrostatic latent image to form a tone image (visible image) on the surface of the photoconductor 21.

Meanwhile, a recording sheet P is fed from one of the sheet feed cassettes 51 in a direction indicated by an arrow A3. When the recording sheet P passes a nip between the photoconductor 21 and the transfer device 26, the toner image on the photoconductor 21 is transferred onto the recording sheet P by action of a transfer electric field formed by the transfer device 26. After the toner-image transfer, the cleaning device 25 removes residual toner and other materials remaining on the surface of the photoconductor 21.

The recording sheet P having the transferred toner image is conveyed in a direction indicated by an arrow A4 and passes the fixing device 27. At this time, the toner image is fixed on the recording sheet P by action of heat and pressure. The pair of output rollers 6 outputs the recording sheet P to the sheet output tray 7.

Below, a description is given of a fixing device in the image forming apparatus 1000.

Figure 3:
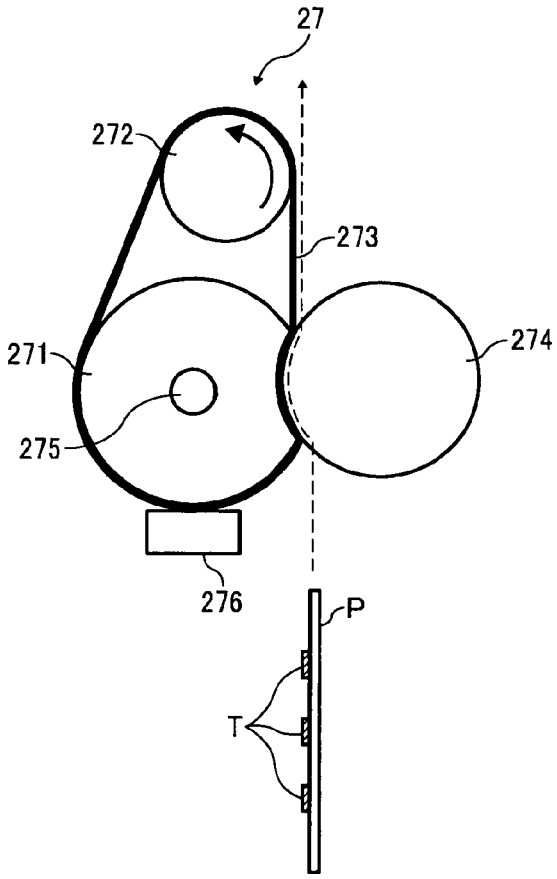
FIG. 3 is a schematic view illustrating a configuration of a fixing device according to an illustrative embodiment of the present disclosure.

FIG. 3 is a schematic view illustrating a configuration of a fixing device 27 according to an illustrative embodiment. In FIG. 3, the fixing device 27 includes a fixing roller 271, a separation roller,272, a fixing belt 273 serving as a rotary fixing member extended around the fixing roller 271 and the separation roller 272, a pressure roller 274 serving as a counter member, a heater 275 serving as a heat source, and a thermistor 276 serving as a temperature detector to detect a temperature of the fixing belt 273. The pressure roller 274 contacts with pressure the fixing belt 273 at a position facing the fixing roller 271. The fixing device 27 includes a contact-and-separation unit, not illustrated in FIG. 3, to switch between a state in which the pressure roller 274 contacts the fixing belt 273 and a state in which the pressure roller 274 is separated from the fixing belt 273. Although in the above-described configuration the pressure roller 274 serving as the counter member is pressed against the fixing roller 271, such a counter member may simply contact the fixing roller 271 without being pressed against the fixing roller 271. Further, such a counter member is not limited to a roller member as described above and may be an irrotational counter member to regulate the recording sheet.

In the fixing roller 271 is disposed the heater 275. The heater 275 is, for example, a halogen heater, an infrared heater, or any other type of heat resistive element.

The fixing roller 271 is formed with a metal roller having an outer diameter of approximately 20 mm. From view points of heat efficiency and so on, the thickness of the fixing roller 271 may be set relatively thin. Meanwhile, since the fixing roller 271 receives bending stress caused by the tension of the fixing belt 273, the thickness of the fixing roller 271 is set equal to or more than, for example, 0.4 mm when the fixing roller 271 is made of aluminum. Alternatively, when the fixing roller 271 is made of iron, the thickness of the fixing roller 271 is set equal to or more than, for example, 0.2 mm. Further, the interior of the fixing roller 271 may be coated with, for example, black-color coating material to facilitate heat absorption.

The separation roller 272 is formed with a metal shaft having an outer diameter of approximately 14 mm covered with an elastic layer, such as silicone rubber, having a relatively large friction coefficient. Since the separation roller 272 receives bending stress caused by the tension of the fixing belt 273 as with the fixing roller 271, a relatively-large shaft diameter may be employed. Meanwhile, to obtain a stable separation performance between the fixing belt 273 and the recording sheet after the fixing, the diameter of the entire separation roller 272 is set equal to or more than, for example, 14 mm.

The fixing belt 273 is, for example, a heat-resistant endless film made of polyimide (PI). Alternatively, the fixing belt 273 includes a substrate made of PI and an elastic layer, such as silicone rubber or fluorocarbon rubber, formed on the substrate. In such a case, a releasing layer made of, for example, PFA (tetra fluoro ethylene-perfluoro alkyl vinyl copolymer) or PTFE (polytetra fluoro ethylene resin) may be formed on an outer surface of the elastic layer. The thickness of the releasing layer is, for example, approximately 20 to 50 μm. Alternatively, the releasing layer may have a tube shape or be formed by coating a fluid type of PFA or PTF or firing a powder type of PFA or PTF. To obtain both a certain degree of flexibility and a sufficient strength to prevent undulation caused by the tension of the fixing belt 273, the thickness of the fixing belt 273 is, for example, approximately 100 to 300 μm.

In the pressure roller 274, an elastic body, such as silicone rubber, is provided on an outer circumferential face of a core metal member having a relatively high rigidity. The outer surface of the pressure roller 274 is made of a member, such as a PFA tube, having an excellent releasing performance. The outer diameter of the pressure roller 274 is set, for example, approximately 30 mm. Alternatively, in the pressure roller 274, the surface of a hollow cylinder may be covered with an elastic layer and another heat source may be provided in the pressure roller 274 separately from the heater 275.

Figure 4:
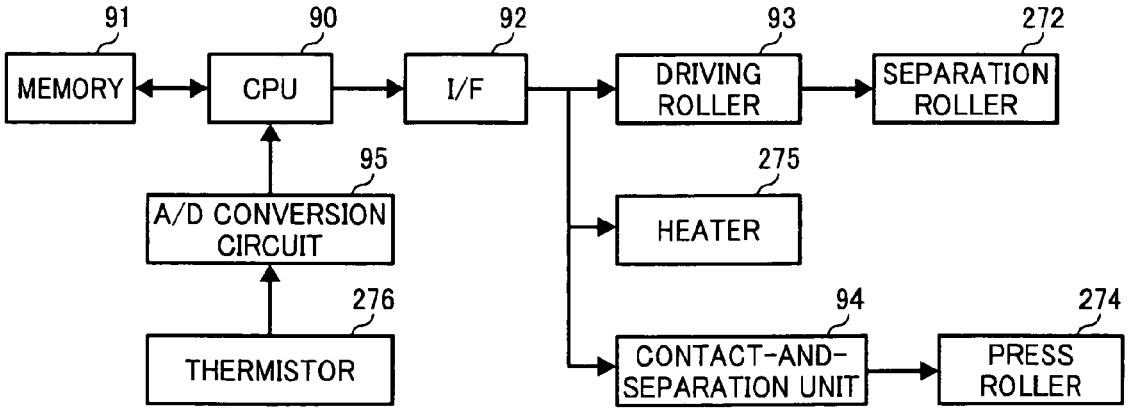
FIG. 4 is a block diagram illustrating a control system of the image forming apparatus illustrated in FIG. 2.

FIG. 4 is a block diagram illustrating a control system that controls the fixing device 27 and other components.

In FIG. 4, a CPU (central processing unit) 90 is a control device that entirely controls operations of the image forming apparatus 1000 including the fixing device 27. The CPU 90 is connected to a memory 91 that stores control and other data. The CPU 90 is also connected via an I/F (interface) 92 to the heater 275 that heats the fixing roller 271, a driving motor 93 serving as a driving unit to rotate the separation roller 272, and the contact-and-separation unit 94 that switches between the contact and separation states of the pressure roller 274 relative to the fixing belt 273. The detection signal representing the temperature of the fixing belt 273 detected by the thermistor 276 is converted to a digital signal by an A/D (analog/digital) conversion circuit 95 and input to the CPU 90.

The control data of the fixing device 27 stored in the memory 91 are, for example, setting temperatures, such as a fixing target temperature and an overshoot temperature of the fixing belt 273, a warm-up time from the turning-on of the heater 275 until the fixing belt 273 rises to the fixing target temperature, timings of turning the heater 275 on and off, and a timing at which the driving motor is started to rotate.

Figure 5:
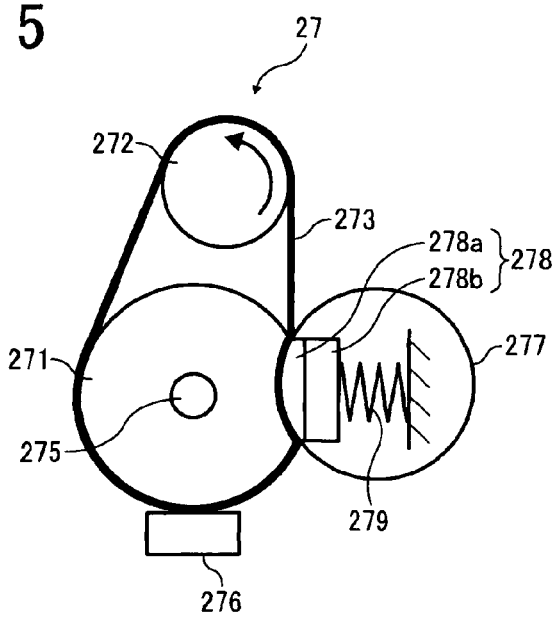
FIG. 5 is a schematic view illustrating a configuration of a fixing device according to an illustrative embodiment of the present disclosure.

FIG. 5 is a schematic view illustrating a configuration of a fixing device 27 according to another illustrative embodiment.

The fixing device 27 illustrated in FIG. 5 differs from that of the above-described illustrative embodiment illustrated in FIG. 3 in the configuration of the rotary pressure member contacting the fixing belt 273 with pressure. In FIG. 5, the same reference numerals are allocated to components similar to those shown in FIG. 4.

The fixing device 27 illustrated in FIG. 5 includes, as a rotary pressure member, an endless-shaped pressure belt 277, a pressing member (pressing pad) 278, and a bias member 279. The pressing member 278 is disposed at a position facing the fixing roller 271 inside the pressure belt 277. By biasing the pressing member 278 toward the fixing roller 271 using the bias member 279, the pressure belt 277 is pressed against the fixing belt 273. The fixing device 27 illustrated in FIG. 5 also includes a contact-and-separation unit to switch between the contact and separation states of the pressure belt 277 relative to the fixing belt 273. A control system of the fixing device 27 illustrated in FIG. 5 has a configuration similar to the control system of the fixing device 27 described with reference to FIG. 4.

The pressure belt 277 is, for example, an endless film made of heat-resistant resin, such as polyimide. Further, a releasing layer made of, for example, PFA or PTFE may be provided on the surface layer of the endless film. The entire thickness of the pressure belt 277 is set to, for example, approximately 100 to 200 μm to obtain both a certain degree of flexibility and a sufficient strength enough to prevent undulation.

The pressing member 278 consists of a base member **278*b* made of, for example, aluminum and an elastic body 278*a* made of, for example, silicone rubber attached to the base member 278*b*. The pressing member 278 is biased by the bias member 279 with a force of approximately 300N to 400N. To reduce the slide resistance between the pressure belt 277 and the pressing member 278, a friction reduction member may be provided between the pressure belt 277 and the pressing member 278**.

Next, basic operation of the fixing device is described below. Since the basic operation of the fixing device illustrated in FIG. 3 is similar to that of the fixing device illustrated in FIG. 5, the basic operation is described below with reference to FIG. 3.

By rotating the separation roller 272 using the driving motor, the fixing roller 271 and the pressure roller 274 are rotated via the fixing belt 273. After the above-described image forming process, a recording sheet P on which an unfixed toner image T has been transferred is conveyed to the fixing device 27 to enter a contact portion (hereinafter, "a fixing nip") between the fixing belt 273 and the pressure roller 274. When the recording sheet P passes the fixing nip, the recording sheet P is heated and pressed so that the unfixed toner image T is fixed on the recording sheet P. After the recording sheet P passes the fixing nip, the recording sheet P is separated from the fixing belt 273 at a position of the separation roller 272 and output to the sheet output tray.

Further, when the fixing device 27 is turned on, a warm-up operation is started to raise the temperature of the fixing belt 273 to a fixing target temperature at which a toner image is fixed on a recording sheet P. Below, the warm-up operation is described with reference to FIGS. 3, 4, and 6A to 6D.

Figure 6A:
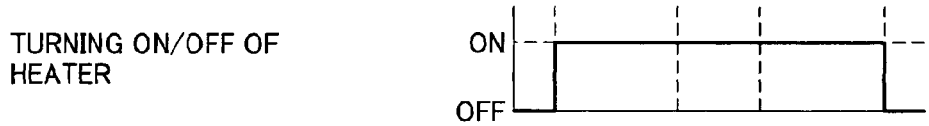
FIG. 6A illustrates a timing chart of controlling the turning-on and -off of a heater.
Figure 6B:
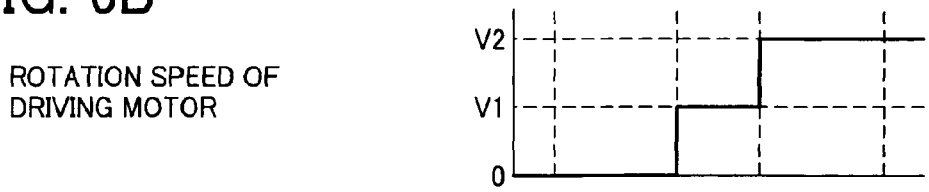
FIG. 6B illustrates a timing chart of rotation control by a driving motor.
Figure 6C:
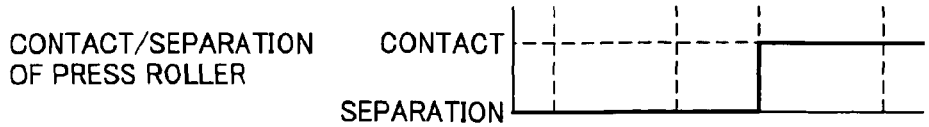
FIG. 6C illustrates a timing chart of controlling a contact-and-separation unit.
Figure 6D:
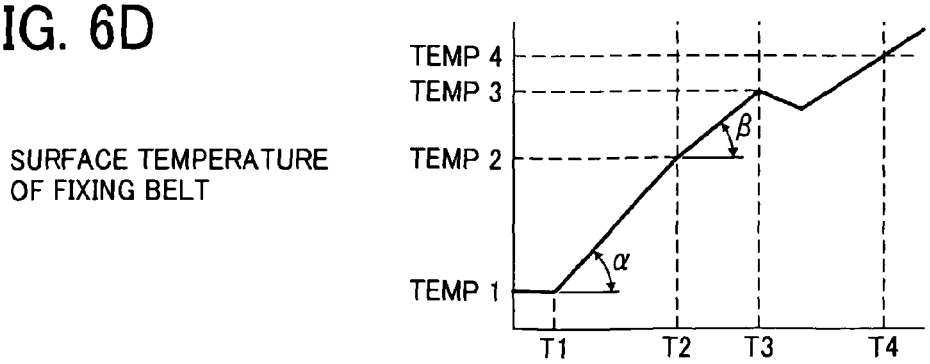
FIG. 6D is a chart illustrating a change in the surface temperature of a fixing belt over time.

FIGS. 6A to 6D are charts illustrating the warm-up operation of the fixing device 27. FIG. 6A is a timing chart illustrating control of turning-on and -off the heater. FIG. 6B is a timing chart illustrating rotation control of the driving motor that drives the separation roller. FIG. 6C is a timing chart illustrating control of contact and separation of the pressure roller by the contact-and-separation unit. FIG. 6D is a chart illustrating a change of the surface temperature of the fixing belt over time.

Before the start of the warm-up operation, the pressure roller 274 is separated from the fixing belt 273 by the contact-and-separation unit 94 (see FIG. 6C). When the driving motor 93 is turned off (see FIG. 6B), the separation roller 272, the fixing roller 271, and the fixing belt 273 are stopped.

At a time T1 at which initial operations, such as checking of a power-supply circuit, are finished after the turning-on of the image forming apparatus, the heater 275 is turned on to start the warm-up operation (see FIGS. 6A and 6D). Heat of the heater 275 is conducted to the fixing belt 273 via the fixing roller 271 to raise the surface temperature of the fixing belt 273 from a room temperature "Temp 1". The surface temperature of the fixing belt 273 is detected by the thermistor 276, and the temperature detection signal of the thermistor 276 is converted to a digital signal by the A/D conversion circuit 95 and input to the CPU 90.

At a time T2 at which the surface temperature of the fixing belt 273 reaches a first setting temperature "Temp 2", the driving motor 93 is turned on to rotate the driving motor 93 at a first rotation speed VI (see FIGS. 6B and 6D). As a result, each of the separation roller 272, the fixing roller 271, and the fixing belt 273 is heated while rotating at a speed corresponding to the first rotation speed V1.

Further, at a time T3 at which the surface temperature of the fixing belt 273 reaches a second setting temperature "Temp 3", the driving motor 93 rotates at a second rotation speed V2 faster than the first rotation speed V1 and the contact-and-separation unit 94 causes the pressure roller 274 to contact the fixing belt 273 with pressure (see FIGS. 6B, 6C, and 6D). As a result, each of the separation roller 272, the fixing belt 273, and the pressure roller 274 is heated while rotating at a speed corresponding to the second rotation speed V2.

When the pressure roller 274 is pressed against the fixing belt 273, heat of the fixing belt 273 is absorbed by the pressure roller 274. Accordingly, although the surface temperature of the fixing belt 273 temporarily falls, the surface temperature of the fixing belt 273 is raised again by continuously heating the fixing belt 273 by the heater 275. Then, at a time T4 at which the surface temperature of the fixing belt 273 reaches a temperature "Temp 4" at which a toner image can be fixed on a recording sheet, the heater 275 is turned off.

In such a case, even when the heater 275 is turned off at the time T4 at which the surface temperature of the pressure roller 274 reaches the temperature "Temp 4" (hereinafter "reload temperature"), a time lag occurs until the heat of the heater 275 is conducted to the fixing belt 273. As a result, the surface temperature of the fixing belt 273 rises beyond the reload temperature "Temp 4". Then, by continuously rotating the fixing belt 273 and the pressure roller 274, the surface temperature of the fixing belt 273 falls. When the surface temperature of the fixing belt 273 falls below the reload temperature "Temp 4", the heater 275 is turned on again. Then, the heater 275 is continuously turned on until the surface temperature of the fixing belt 273 rises to the reload temperature "Temp 4". Further, the heater 275 is controlled to turn on each time the surface temperature of the fixing belt 273 falls below the reload temperature "Temp 4".

In the above description, although the warm-up operation is described with the example of the fixing device 27 illustrated in FIG. 3, the warm-up operation of the fixing device 27 illustrated in FIG. 5 is performed in a similar manner.

When the fixing device 27 performs the warm-up operation, the heater 275 starts to heat the fixing belt 273 with the fixing belt 273 stopped and separated from the pressure roller 274. As a result, the heat of the heater 275 is intensively conducted to a portion of the fixing belt 273 contacting the fixing roller 271. Such a configuration suppresses transmission of the heat of the heater 275 to the separation roller 272, the pressure roller 274, and a portion of the fixing belt 273 not contacting the fixing roller 271, thus preventing increase in the radiation area. Accordingly, the rising speed of the surface temperature of the fixing belt 273 is increased, thus shortening the warm-up time.

Further, the present inventors performed an experiment to compare the temperature rise of the fixing belt with the pressure roller separated from the fixing belt with the temperature rise of the fixing belt with the pressure roller contacting the fixing belt. Below, the experiment is described in details.

As shown in Table 1 listed below, two types of fixing belt were tested in the experiment. One type of fixing belt consisted of a PI substrate having a thickness of 0.1 mm and an elastic layer made of silicone rubber having a thickness of 0.2 mm. The elastic layer was formed on the PI substrate. The other type of fixing belt was formed with only the PI substrate having a thickness of 0.1 mm. Under a total of four conditions ("a" to "d" in Table. 1), that is, the two, contact and separation, states of the pressure roller relative to the two types of fixing belt, the fixing belt was heated and started rotating when the temperature of the fixing belt reached the first setting temperature. The temperature rising slope of the fixing belt during stop state (corresponding to "α" illustrated in FIG. 6D) and the temperature rising slope during rotation (corresponding to "β" illustrated in FIG. 6D) were measured. Except the above-described difference, the fixing devices including the respective types of fixing belt were configured in a similar manner and the other experimental conditions were set the same. The surface temperature of the fixing belt (corresponding to the first setting temperature "Temp 2" illustrated in FIG. 6D) at which the fixing belt started rotating was set to 60 degrees, and the surface temperature of the fixing belt (corresponding to the second setting temperature "Temp 3" illustrated in FIG. 6D) at which the pressure roller was pressed against the fixing belt was set to 160 degrees.

TABLE 1

| CONDITION | CONSTITUTION OF FIXING BELT | STATE OF PRESSURE ROLLER | TEMPERATURE RISING SLOPE (α) DURING STOP STATE [deg/sec] | TEMPERATURE RISING SLOPE (β) DURING ROTATION [deg/sec] |
|---|---|---|---|---|
| a | PI + Si rubber | contact | 17 | 4.8 |
| b | PI | separation | 16.7 | 6.9 |
| c | PI | contact | 16.7 | 8.9 |
| d | PI | separation | 22 | 16.3 |

In Table 1, comparing measurement results of the temperature rising slope (α) during stop state and the temperature rising slope (β) during rotation between the conditions "a" and "b" and between the conditions "c" and "d", which are identical in the constitution of the fixing belt, the temperature rising slope (β) of the fixing belt separated from the pressure roller is considerably greater than that of the fixing belt contacting the pressure roller. Although not so remarkable, the temperature rising slope (α) of the fixing belt separated from the pressure roller is equal to or greater than that of the fixing belt contacting the pressure roller. One conceivable reason is that separating the pressure roller from the fixing belt may prevent increase in the radiation area of the fixing belt and effectively raise the temperature of the fixing belt. Further, comparing measurement results of the temperature rising slope (α) during stop state and the temperature rising slope (β) during rotation between conditions "b" and "d" in which the pressure roller was separated from the fixing roller, the measurement values of the condition "d" are greater than those of the condition "b". One conceivable reason is that since the fixing belt under the condition "d" was entirely thinner than the fixing belt under the condition "b", the heat amount required to raise the temperature of the fixing belt under the condition "d" was less than that of the fixing belt under the condition "b".

In the warm-up operation of the fixing device according to the present illustrative embodiment, when the surface temperature of the fixing belt has reached the first setting temperature, the driving motor starts rotating. Then, when the surface temperature of the fixing belt has reached the second setting temperature, the pressure roller is pressed against the fixing belt. That is, the rotation of the driving motor is not started simultaneously with the pressure-contact of the pressure roller against the fixing belt. One reason for employing such a configuration is described below.

Figure 7:
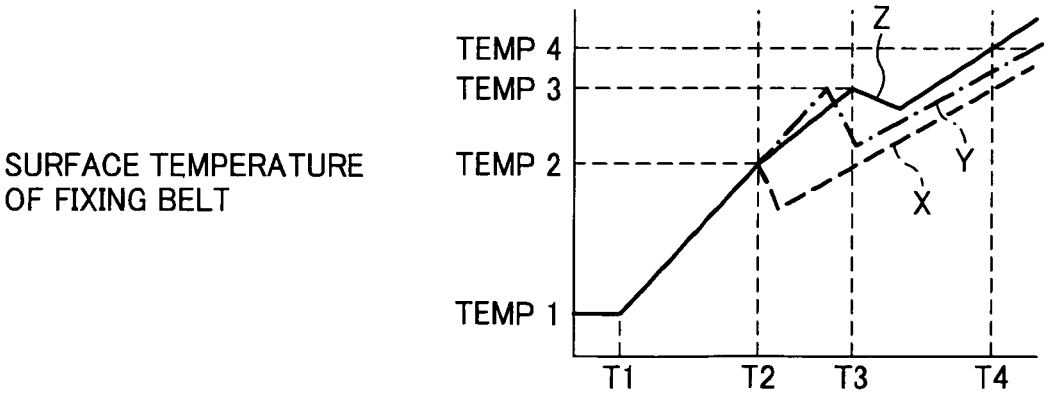
FIG. 7 is a chart illustrating changes in the surface temperature of a fixing belt in warm-up operation over time.

In FIG. 7, a dotted line X represents a change in the surface temperature of the fixing belt obtained when, at the time T2 at which the surface temperature of the fixing belt has reached the first setting temperature "Temp 2", the driving motor starts rotating and, at the same time, the pressure roller is pressed against the fixing belt. Further, in FIG. 7, a long-and-short dashed line Y represents a change in the surface temperature of the fixing belt obtained when, at the time T3 at which the surface temperature of the fixing belt has reached the second setting temperature "Temp 3", the driving motor starts rotating and, at the same time, the pressure roller is pressed against the fixing belt. Further, a full line Z represents a change in the surface temperature of the fixing belt during the warm-up operation of the fixing device. In other words, as with the description with reference to FIG. 6D, the full line Z represents a change in the surface temperature of the fixing belt obtained when, at the time T2 at which the surface temperature of the fixing belt has reached the first setting temperature "Temp 2", the driving motor starts rotating and then, at the time T3 at which the surface temperature of the fixing belt has reached the second setting temperature "Temp 3", the pressure roller is pressed against the fixing belt.

As illustrated in the dotted line X illustrated in FIG. 7, when at the time T2 the rotation of the driving motor is started simultaneously with the pressure-contact of the pressure roller against the fixing belt, the surface temperature of the fixing belt rapidly falls. This is conceivably because heat of the heater is dispersedly transmitted to the separation roller, the pressure roller, and a portion of the fixing belt not contacting the fixing roller, and the heat of the fixing belt is absorbed by the pressure roller. Although the surface temperature of the fixing belt 273 rises again after the temperature decrease, an increased radiation area results in an increased radiation amount. The temperature rising slope of the dotted line X becomes modest as compared with the temperature rising slope of the full line Z. Accordingly, the surface temperature of the fixing belt more slowly rises to the reload time "Temp 4", lengthening the warm-up time.

When at the time T3 the rotation of the driving motor is started simultaneously with the pressure-contact of the pressure roller against the fixing belt, the surface temperature of the fixing belt rapidly falls for the same reason as the case of the dotted line X. Although the surface temperature of the fixing belt rises again after the temperature decrease, an increase in the radiation area of the fixing belt results in an increased radiation amount. Accordingly, the temperature rise represented by the long-and-short dashed line Y does not catch up with the temperature rise represented by the full line Z.

As described above, when the rotation of the driving motor is started simultaneously with the pressure-contact of the pressure roller against the fixing belt, the temperature of the fixing belt rapidly falls. Then, a large heat capacity of the fixing belt may prevent rapid temperature rise. Therefore, the control of preventing a rapid fall in the raised temperature of the fixing belt and gradually increasing the radiation amount is effective to shorten the time required for raising the temperature. Hence, in the warm-up operation of the fixing device, the rotation of the driving motor is started at a time differing from the time at which the pressure roller is pressed against the fixing belt.

Further, an increase in the radiation amount caused by pressure-contacting the pressure roller against the fixing roller is greater than an increase in the radiation amount caused by rotating the fixing belt. Hence, in the present illustrative embodiment, to further suppress heat radiation during the warm-up operation, the timing of the pressure-contact of the pressure roller is delayed relative to the start of rotation of the fixing roller.

Further, in the warm-up operation of the fixing device, the rotation speed (the second rotation speed V2) of the driving motor after the surface temperature of the fixing belt has reached the second setting temperature is set faster than the rotation speed (the first rotation speed V1) of the driving motor while the surface temperature of the fixing belt rises from the first setting temperature to the second setting temperature. Setting a relatively-low rotation speed of the driving motor is likely to generate a steep temperature-rising slope of the fixing belt. Such a steep temperature-rising slope increases the amount of overshoot in which the surface temperature of the fixing belt exceeds the target reload temperature, which may lengthen a period of time needed until the surface temperature of the fixing belt converges to the reload temperature. Hence, in the above-described warm-up operation, the rotation speed of the driving motor is set relatively low and the temperature-rising speed of the fixing belt is set relatively high until the surface temperature of the fixing belt reaches the second setting temperature. Further, after the surface temperature of the fixing belt has reached the second setting temperature, the rotation speed of the driving motor is set relatively high to suppress the overshoot.

As described above, the fixing device and the image forming apparatus employing the fixing device according to any of the above-described illustrative embodiments provides an enhanced speed of raising the temperature of the rotary fixing member (or the counter member), shortening the time needed until the temperature of the rotary fixing member reaches a fixing target temperature. Such a configuration can shorten a waiting time of a user and achieve cost reduction through energy saving.

Although certain illustrative embodiments of the fixing device and the image forming apparatus employing the fixing device are described above, numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, in the fixing device, the fixing roller and the pressure roller, which are illustrated in FIG. 1, may directly contact with each other. However, in the above-described configuration using the fixing belt, a sufficient width (area) of the fixing nip is obtained independently of the diameter of the fixing roller. Accordingly, the diameter of the fixing roller can be set relatively small to reduce the heat capacity, effectively raising the temperature of the fixing belt.

Alternatively, a pressure belt having a relatively low heat capacity may be used as the rotary pressure member (see FIG. 5), allowing suppression of the temperature fall of the fixing belt when the pressure belt starts to contact the fixing belt with pressure. Further, the pressure roller may be hollow to reduce the heat capacity. Alternatively, besides the heater of the fixing roller, another heater may be provided in the pressure roller, allowing further shortening of the warm-up time.

In the configuration in which the fixing belt is rotated as the separation roller rotates, the fixing belt is not bent at the exit of the fixing nip. Such a configuration provides effective heat transmission to the fixing belt, which is advantageous in shortening the warm-up time.

Further, setting the outer diameter of the fixing roller substantially equal to or greater than the separation roller or any other roller around which the fixing belt is looped provides a relatively large loop angle of the fixing belt relative to the fixing roller. Thus, a relatively large contact area of the fixing belt with the fixing roller is obtained, providing enhanced heat-transmission from the fixing roller to the fixing belt.

Although in the above-described illustrative embodiment the fixing device is included in the image forming apparatus having one photoconductor, the image forming apparatus may be a so-called "tandem-type" color image forming apparatus including, for example, four photoconductors, an intermediate-transfer-type image forming apparatus in which toner images carried on photoconductors are transferred onto a recording sheet via an intermediate transfer member, or any other type of image forming apparatus.

What is claimed is:

1. A fixing device, comprising:

a rotary fixing member;

a counter member to contact the rotary fixing member at a contact portion through which a recording medium is passed to fix an image thereon;

a first heater to heat the rotary fixing member;

a driving unit to rotate the rotary fixing member;

a temperature detector to detect a temperature of the rotary fixing member; and a contact-and-separation unit to switch between contact and separation states of the rotary fixing member relative to the counter member, wherein, in a temperature-raising operation of raising the temperature of the rotary fixing member to a temperature at which the image is fixed on the recording medium, the driving unit causes the rotary fixing member to rotate when the temperature detector detects that the temperature of the rotary fixing member has reached a first setting temperature, and the contact-and-separation unit causes the rotary fixing member in rotation and the counter member to contact each other when the temperature detector detects that the temperature of the rotary fixing member has reached a second setting temperature that is higher than the first setting temperature, wherein a rotation speed of the rotary fixing member is variable while the temperature of the rotary fixing member increases, and the rotation speed of the rotary fixing member after the temperature of the rotary fixing member has reached the second setting temperature is set faster than a rotation speed of the rotary fixing member while the temperature of the rotary fixing member rises from the first setting temperature to the second setting temperature, and wherein, during the temperature-raising operation, the first heater starts to heat the rotary fixing member while the rotary fixing member is stopped and separated from the counter member.

2. The fixing device according to claim 1, wherein the counter member is a rotary pressure member to contact the rotary fixing member with pressure.

3. The fixing device according to claim 1, further comprising a plurality of rollers, wherein the rotary fixing member is an endless belt extended around the plurality of rollers.

4. The fixing device according to claim 3, wherein the plurality of rollers comprises a fixing roller disposed opposite the counter member and a separation roller disposed on a downstream side of the fixing roller in a conveyance direction of the recording medium and rotated by the driving unit.

5. The fixing device according to claim 4, wherein an outer diameter of the fixing roller is equal to or greater than an outer diameter of any of the plurality of rollers.

6. The fixing device according to claim 1, wherein the counter member is a pressure roller comprising a hollow cylinder and an elastic layer covering a surface of the cylinder.

7. The fixing device according to claim 6, wherein the pressure roller further comprises a second heater provided separately from the first heater.

8. The fixing device according to claim 1, wherein the counter member is an endless belt.

9. An image forming apparatus comprising a fixing device, the fixing device including:

a rotary fixing member;

a counter member to contact the rotary fixing member at a contact portion through which a recording medium is passed to fix an image thereon;

a first heater to heat the rotary fixing member;

a driving unit to rotate the rotary fixing member;

a temperature detector to detect a temperature of the rotary fixing member; and a contact-and-separation unit to switch between contact and separation states of the rotary fixing member relative to the counter member, wherein, in a temperature-raising operation of raising the temperature of the rotary fixing member to a temperature at which the image is fixed on the recording medium, the driving unit causes the rotary fixing member to rotate when the temperature detector detects that the temperature of the rotary fixing member has reached a first setting temperature, and the contact-and-separation unit causes the rotary fixing member in rotation and the counter member to contact each other when the temperature detector detects that the temperature of the rotary fixing member has reached a second setting temperature that is higher than the first setting temperature, wherein a rotation speed of the rotary fixing member is variable while the temperature of the rotary fixing member increases, and the rotation speed of the rotary fixing member after the temperature of the rotary fixing member has reached the second setting temperature is set faster than a rotation speed of the rotary fixing member while the temperature of the rotary fixing member rises from the first setting temperature to the second setting temperature, and wherein, during the temperature-raising operation, the first heater starts to heat the rotary fixing member while the rotary fixing member is stopped and separated from the counter member.

10. The image forming apparatus according to claim 9, wherein the counter member is a rotary pressure member to contact the rotary fixing member with pressure.

11. The image forming apparatus according to claim 9, further comprising a plurality of rollers, wherein the rotary fixing member is an endless belt extended around the plurality of rollers.

12. The image forming apparatus according to claim 11, wherein the plurality of rollers comprises a fixing roller disposed opposite the counter member and a separation roller disposed on a downstream side of the fixing roller in a conveyance direction of the recording medium and rotated by the driving unit.

13. The image forming apparatus according to claim 12, wherein an outer diameter of the fixing roller is equal to or greater than an outer diameter of any of the plurality of rollers.

14. The image forming apparatus according to claim 9, wherein the counter member is a pressure roller comprising a hollow cylinder and an elastic layer covering a surface of the cylinder.

15. The image forming apparatus according to claim 14, wherein the pressure roller further comprises a second heater provided separately from the first heater.

16. The fixing device according to claim 9, wherein the counter member is an endless belt.

* * * * *

UNITED STATES PATENT AND TRADEMARK OFFICE

CERTIFICATE OF CORRECTION

PATENT NO. : 8,417,137 B2
APPLICATION NO. : 12/461314
DATED : April 9, 2013
INVENTOR(S) : Naitoh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 737 days.

Signed and Sealed this
Sixteenth Day of December, 2014

Michelle K. Lee

Michelle K. Lee
*Deputy Director of the United States Patent and Trademark Office*